US009233792B2

(12) United States Patent
Kooi

(10) Patent No.: US 9,233,792 B2
(45) Date of Patent: Jan. 12, 2016

(54) TANK CONTAINER

(71) Applicant: TRS Transportkoeling B.V., Noordwijk (NL)

(72) Inventor: Eeuwe Durk Kooi, Noordwijk (NL)

(73) Assignee: TRS Transportkoeling B.V., Noordwijk (NL)

( * ) Notice: Subject to any disclaimer, the term of this patent is extended or adjusted under 35 U.S.C. 154(b) by 167 days.

(21) Appl. No.: 14/060,828

(22) Filed: Oct. 23, 2013

(65) Prior Publication Data

US 2014/0124497 A1 May 8, 2014

(30) Foreign Application Priority Data

Nov. 2, 2012 (NL) ..... 2009749

(51) Int. Cl.
*B65D 88/74* (2006.01)
*B65D 88/12* (2006.01)

(52) U.S. Cl.
CPC ..... *B65D 88/748* (2013.01); *B65D 88/128* (2013.01); *B65D 88/744* (2013.01); *H05B 2203/021* (2013.01); *Y10T 137/6579* (2013.01); *Y10T 137/6606* (2013.01)

(58) Field of Classification Search
None
See application file for complete search history.

(56) References Cited

U.S. PATENT DOCUMENTS

| | | | |
|---|---|---|---|
| 4,359,084 | A | 11/1982 | Geverath et al. |
| 2013/0192684 | A1 | 8/2013 | Ohkami et al. |

FOREIGN PATENT DOCUMENTS

| | | | |
|---|---|---|---|
| DE | 202012005624 | U1 | 9/2012 |
| EP | 0256292 | A2 | 2/1988 |
| KR | 101267110 | B1 * | 5/2013 |
| NL | 2004667 | | 11/2011 |
| WO | 2011129306 | A1 | 10/2011 |

* cited by examiner

*Primary Examiner* — Joseph M Pelham
(74) *Attorney, Agent, or Firm* — The Webb Law Firm

(57) ABSTRACT

A tank container comprising a container for a liquid to be stored or transported, a pipe circuit comprising a heat transfer circuit part mounted to the wall of the container, which pipe circuit is filled with glycol, a storage vessel connected to the pipe circuit for holding an amount of glycol, a heating device designed for selectively heating the glycol in the pipe circuit, and a pump in the pipe circuit for circulating the glycol, wherein a second heating device is provided in or around the storage vessel, which heating device is designed for maintaining the temperature of the glycol in the storage vessel at at least 25° C., preferably at least 35° c.

20 Claims, 1 Drawing Sheet

TANK CONTAINER

CROSS-REFERENCE TO RELATED APPLICATIONS

This application claims priority to Netherlands Patent Application No. 2009749 filed on Nov. 2, 2012 in the Netherlands Intellectual Property Office, the disclosure of which is hereby incorporated by reference in its entirety.

BACKGROUND OF THE INVENTION

1. Field of the Invention

The present invention relates to a tank container comprising a container for a liquid to be stored or transported, a pipe circuit comprising a heat transfer circuit part mounted to the wall of the container, which pipe circuit is filled with glycol, a storage vessel connected to the pipe circuit for holding an amount of glycol, a heating device designed for selectively heating the glycol in the pipe circuit, and a pump in the pipe circuit for circulating the glycol.

2. Description of Related Art

As a rule, the container is a substantially cylindrical tank, for example having a diameter of about 2.5 meters, a length of about 6 meters and a capacity of about 26,000 liters, which tank is often mounted in a block-shaped frame having an ISO 20 feet dimension.

Usually, such heating systems for tank containers use a cooling medium consisting of a mixture of glycol and water mixture in a proportion of about 1:1, the maximum temperature of the mixture being 100° C. If a cooling medium temperature of between 100° C. and 140° C. is required, the cooling medium will have to consist of at least substantially 100% pure glycol, because the boiling point of pure glycol is well above 150° C. The drawback of pure glycol is that it has a high viscosity at lower temperatures (below 25° C.), so that pumping it is difficult and gradually becomes impossible. This is problematic especially if the heating system has been off for some time and circulation of the cooling medium must be started.

SUMMARY OF THE INVENTION

The object of the invention is to solve this problem.

According to the invention, a second heating device is to that end provided in or around the storage vessel, which heating device is designed for maintaining the temperature of the glycol in the storage vessel at at least 25° C., preferably at least 35° C. In this way the glycol can be brought to a temperature at which the glycol can be circulated independently of the ambient temperature.

The pump is preferably designed for circulating the glycol only when the temperature of the glycol in the storage vessel exceeds a predetermined limiting value, preferably at least 25° C., more preferably at least 35° C. To that end a thermostat fitted with a sensor is preferably mounted in or to the storage vessel, which thermostat is capable of turning the pump or on and off. The pump is preferably incorporated in the pipe circuit (directly) after the storage vessel and before the aforesaid heating device.

Preferably, a thermostat valve provided with a bypass line is incorporated in the pipe circuit after the aforesaid heating device and before the heat transfer circuit part, which thermostat valve is designed for causing at least part of the glycol to flow back to the storage vessel if the temperature of the glycol in the pipe circuit before the inlet of the storage vessel is lower than a predetermined limiting value, for example 35° C. or 25° C. This prevents cold glycol flowing back into the storage vessel if the tank container is completely cold, and thus the need to start the heating cycle all over again. If there is a flow in the pipe circuit, the main heating element can remain on. The system will thus reach its desired minimum temperature sooner. In an alternative embodiment, a pressure-controlled valve (for example a spring-loaded valve) provided with a bypass line is installed in the pipe circuit after the first heating device and before the heat transfer circuit part, which valve is designed to cause at least part of the glycol to flow back to the storage vessel when the pressure of the glycol in the pipe circuit exceeds a predetermined limiting value. Too high a viscosity of the glycol at a low temperature will cause the pressure experienced by the pump, for example, to increase. At that point the valve can be opened for causing at least the aforesaid part of the glycol to flow back to the storage vessel so as to be heated.

The second heating device preferably comprises an electrical heating coil in the storage vessel. The second heating device is preferably designed for pulsed heating. This prevents burning of the glycol that is in contact with the heating coils. When pulsed heating by the heating coils is used, the glycol that is in contact with the heating coils will have sufficient time for transferring the heat it has absorbed to the glycol that is present further on.

Preferably, the first heating device likewise comprises an electrical heating element.

DESCRIPTION OF THE INVENTION

Figure 1:
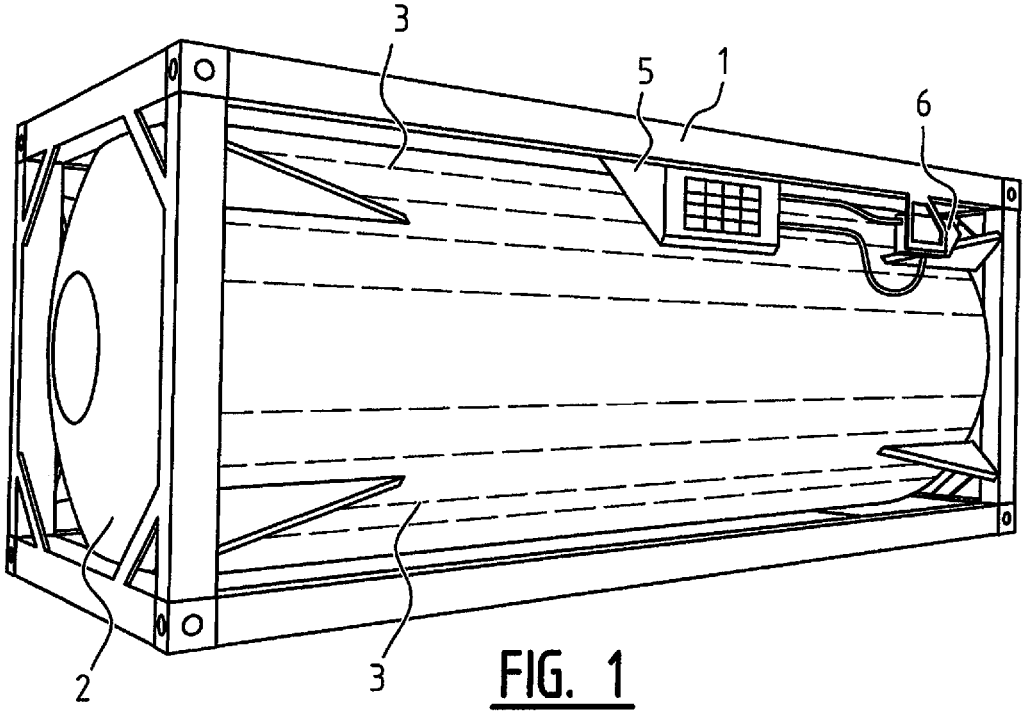
FIG. 1 is a perspective view of a tank container according to the invention.

FIG. 1 shows a tank container comprising an ISO 20 feet frame 1 with a cylindrical container 2. Mounted to the cylindrical wall of the container 2 is a glycol circuit 3, which comprises about 14 parallel channels. A casing 5 containing a heating system is mounted at the top of the frame 1. Mounted at the top of the frame 1, near the corner thereof, is a glycol storage vessel 6. The storage vessel 6 can also serve as an expansion vessel, because it is positioned at the top of the system.

Figure 2:
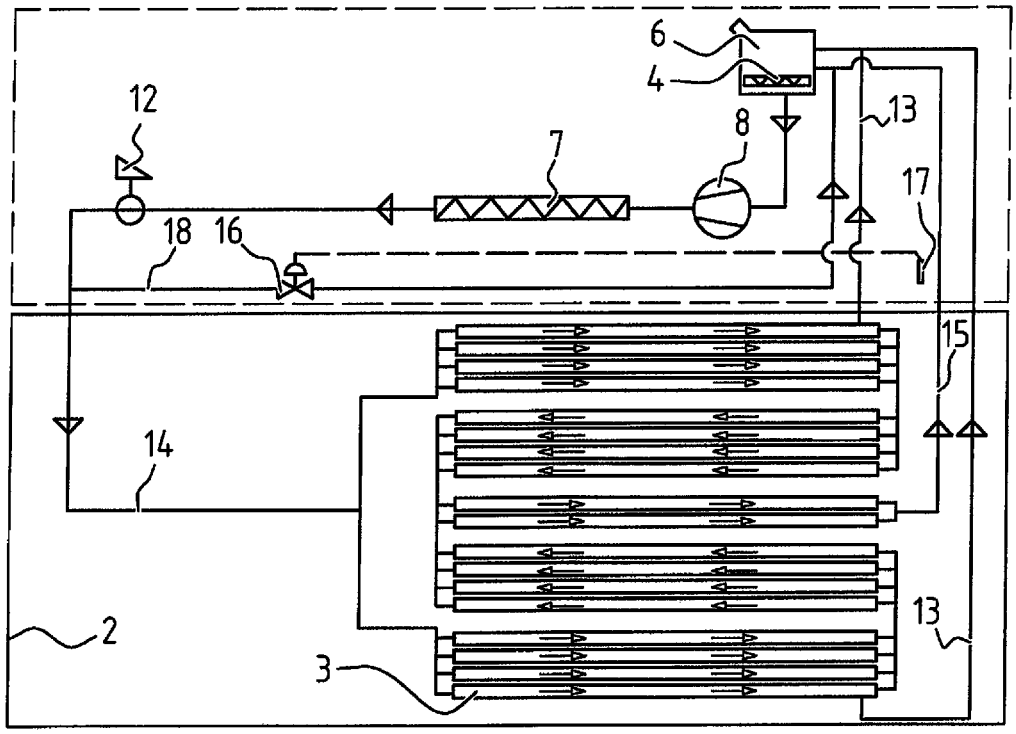
FIG. 2 is a schematic representation of the heating system in the tank container of FIG. 1.

With reference to the diagram of FIG. 2, the heating system in the casing 5 comprises a pump 8 and an electrical heating element 7 in the glycol supply line 14, downstream of the storage vessel 6. The circuit further comprises a current switch 12. Vent lines 13 extend from various places in the glycol circuit 3 on the container 2 to the storage vessel 6. The glycol discharge line 15 carries the glycol from the end of the glycol circuit 3 on the container 2 to the storage vessel 6.

Electrical heating coils 4 are disposed in the glycol vessel 6, by which heating coils the glycol supply, and to a certain extent also the other parts of the system, are pre-heated. As soon as the glycol reaches a temperature of about 40° C., the pump 8 will turn on, causing the glycol to circulate, and the heating element 7 will turn on.

In a preferred embodiment, a thermostat valve 16 is incorporated in a bypass line 18 between the supply line 14 and the discharge line 15, which thermostat valve 16 is connected to a temperature sensor on the discharge line 15, and which is set so that the glycol will be pumped back (in part) to the storage vessel again when the temperature in the discharge line falls below a predetermined temperature, for example about 35° C.

This prevents cold glycol flowing back into the storage vessel 6 and thus a complete restart of the heating cycle when the container 2 is completely cold. When there is a flow, the main heating element 7 can remain on, so that the system will soon reach its desired minimum temperature.

Since glycol has a lower heat conduction coefficient than water, pulsed heating is employed with the heating coil in the glycol storage vessel 6 in a preferred embodiment, because otherwise the glycol that is in contact with the heating coils 4 will burn. In the case of pulsed heating by the heating coils 4, the glycol being in contact with the heating coils will have sufficient time for transferring the absorbed heat to the glycol present further on.

The invention claimed is:

1. A tank container comprising a container for a liquid to be stored or transported, a pipe circuit comprising a heat transfer circuit part mounted to the wall of the container, which pipe circuit is filled with glycol, a storage vessel connected to the pipe circuit for holding an amount of glycol, a heating device designed for selectively heating the glycol in the pipe circuit, and a pump in the pipe circuit for circulating the glycol, wherein a second heating device is provided in or around the storage vessel, which heating device is designed for maintaining the temperature of the glycol in the storage vessel at at least 25° C.

2. The tank container according to claim 1, wherein the pump is designed for circulating the glycol only when the temperature of the glycol in the storage vessel exceeds a predetermined limiting value.

3. The tank container according to claim 1, wherein the pump is incorporated in the pipe circuit after the storage vessel and before the first heating device.

4. The tank container according to claim 1, wherein a thermostat valve provided with a bypass line is incorporated in the pipe circuit after the aforesaid heating device and before the heat transfer circuit part, which thermostat valve is designed for causing at least part of the glycol to flow back to the storage vessel if the temperature of the glycol in the pipe circuit before the inlet of the storage vessel is lower than a predetermined limiting value.

5. The tank container according to claim 1, wherein a pressure-controlled valve provided with a bypass line is installed in the pipe circuit after the first heating device and before the heat transfer circuit part, which valve is designed to cause at least part of the glycol to flow back to the storage vessel when the pressure of the glycol in the pipe circuit exceeds a predetermined limiting value.

6. The tank container according to claim 1, wherein the second heating device is designed for pulsed heating.

7. The tank container according to claim 1, wherein the second heating device comprises an electrical heating coil in the storage vessel.

8. The tank container according to claim 1, wherein the glycol is at least substantially 100% pure glycol.

9. The tank container according to claim 1, wherein the first heating device is designed for heating the glycol to a temperature of between 100° C. and 140° C.

10. The tank container according to claim 1, wherein the first heating device comprises an electrical heating element.

11. The tank container according to claim 1, wherein the container is a substantially cylindrical tank.

12. The tank container according to claim 1, wherein the container is mounted in a block-shaped frame.

13. The tank container according to claim 1, wherein the heating device is designed for maintaining the temperature of the glycol in the storage vessel at at least 35° C.

14. The tank container according to claim 2, wherein the predetermined limiting value is at least 25° C.

15. The tank container according to claim 2, wherein the predetermined limiting value is at least 35° C.

16. The tank container according to claim 2, wherein the pump is incorporated in the pipe circuit after the storage vessel and before the first heating device.

17. The tank container according to claim 2, wherein a thermostat valve provided with a bypass line is incorporated in the pipe circuit after the aforesaid heating device and before the heat transfer circuit part, which thermostat valve is designed for causing at least part of the glycol to flow back to the storage vessel if the temperature of the glycol in the pipe circuit before the inlet of the storage vessel is lower than a predetermined limiting value.

18. The tank container according to claim 3, wherein a thermostat valve provided with a bypass line is incorporated in the pipe circuit after the aforesaid heating device and before the heat transfer circuit part, which thermostat valve is designed for causing at least part of the glycol to flow back to the storage vessel if the temperature of the glycol in the pipe circuit before the inlet of the storage vessel is lower than a predetermined limiting value.

19. The tank container according to claim 2, wherein a pressure-controlled valve provided with a bypass line is installed in the pipe circuit after the first heating device and before the heat transfer circuit part, which valve is designed to cause at least part of the glycol to flow back to the storage vessel when the pressure of the glycol in the pipe circuit exceeds a predetermined limiting value.

20. The tank container according to claim 3, wherein a pressure-controlled valve provided with a bypass line is installed in the pipe circuit after the first heating device and before the heat transfer circuit part, which valve is designed to cause at least part of the glycol to flow back to the storage vessel when the pressure of the glycol in the pipe circuit exceeds a predetermined limiting value.

* * * * *